United States Patent [19]

Drone et al.

[11] 4,222,287

[45] Sep. 16, 1980

[54] MULTIPLE CONTROL LOCKING DEVICE

[75] Inventors: Gary A. Drone; Evsey P. Levin, both of Springfield, Ill.

[73] Assignee: Fiat-Allis Construction Machinery, Inc., Deerfield, Ill.

[21] Appl. No.: 890,251

[22] Filed: Mar. 27, 1978

[51] Int. Cl.[2] ..... G05G 5/06

[52] U.S. Cl. ..... 74/529; 74/532; 70/181; 70/199

[58] Field of Search ..... 74/527, 529, 532; 70/198, 199, 181; 312/216, 217

[56] References Cited

U.S. PATENT DOCUMENTS

| | | | |
|---|---|---|---|
| 1,475,863 | 11/1923 | Pate | 70/199 |
| 2,597,684 | 5/1952 | Stringe | 312/217 |
| 3,005,671 | 10/1961 | Majeski | 312/216 |
| 4,075,908 | 2/1978 | Suzuki | 74/527 |

*Primary Examiner*—Kenneth Dorner

*Attorney, Agent, or Firm*—Jacque L. Meister; Robert A. Brown; John A. Doninger

[57] ABSTRACT

An apparatus providing means for locking the controls of construction machinery in a safe position. Implements are maintained in a preset position safe from inadvertant control activation by an operator controlled locking gate which engages the control activating linkages when they are in a neutral position. A single locking gate may be used to lock several controls and unlocking, controlled by the operator, unlocks all of the previously locked controls.

7 Claims, 4 Drawing Figures

102
22
24
10
100
42
44
106
108
34
64
52
104
60
98
70
32
40
46
54
66
90
84
30
38
72
48
56
76
78
28
94
36
50
82
58
26
96
86
88

MULTIPLE CONTROL LOCKING DEVICE

BACKGROUND OF THE INVENTION

This invention relates to an operator controlled lock for one or more machinery controls and more particularly to means for locking the plural implement controls of construction machinery.

In construction machinery and in particular in earth moving machinery, numerous controls to effect a change in implement position, are under direct control. For example, in a crawler type tractor of the type usually referred to as a "bull-dozer," the operator would control the position of the moldboard (frequently referred to as the "blade" or "dozer blade" ) up and down relative to the ground, its angle with respect to the crawlers front, and its verticallity. Other controls may be present for other implements. Since implement repositioning can take place while the crawler is moving and possibly turning, it is desirable that there be a control lock for the implements to prevent their inadvertant engagement. It can be seen that inadvertant control engagement could be hazardous to both the machinery operator and others.

SUMMARY OF THE INVENTION

A principal object of the invention is to provide a new and improved lock for machinery controls.

Another object of the present invention is to provide a new and improved machinery control lock adapted to lock plural controls with a single lock.

Still another object of the invention is to provide a new and improved machinery control lock that is simple and inexpensive of construction and yet positive in its locking action.

Yet another object of the invention is to provide a new and improved machinery control lock that requires no radial indexing to effect locking.

The foregoing and other objects of the invention are achieved by a mechanism in which a gate or key is positioned in a circumferential groove on the control linkage. By arranging the control linkages of plural controls, each with their respective circumferential groove in a straight line, a straight gate or key can be used to lock all or particular ones of the plural controls. The nature of the invention and its several features and objects will more readily be apparent from the following description of certain preferred embodiments thereof taken in conjunction with the accompanying drawings.

DESCRIPTION OF THE PREFERRED EMBODIMENTS

Figure 1:
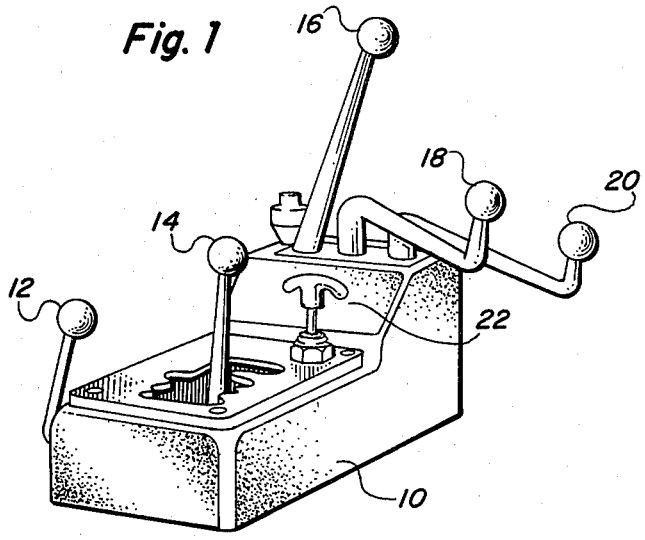
FIG. 1 is a perspective view of a typical machinery hydraulic control console as viewed from the position of the operator.

FIG. 1 illustrates a typical implement control console such as might be found on a crawler type tractor of the type commonly known as a bulldozer. As shown, the control console 10, has protruding therefrom a number of implement actuating levers 12, 14, 16, 18 and 20. These levers might be used for ripper pitch, ripper right and left movement, moldboard (dozer blade) movement up and down, left and right, etc. Each particular machine would have different functions associated with the different levers and there is no intent here to limit the application of the invention to the described functions but rather to describe the operator's environment generally.

In a crawler tractor situation, one of the foregoing enumerated levers is ordinarily used to control one of the vehicle treads. As can be seen from FIG. 1, because of the necessarily close proximity of the several controls it would be possible and even likely under severe operating conditions, to inadvertently operate one of the implement control levers while generally operating the tractor. It is to prevent this possibility of inadvertant operation of implement controls that the invention is directed.

Figure 2:
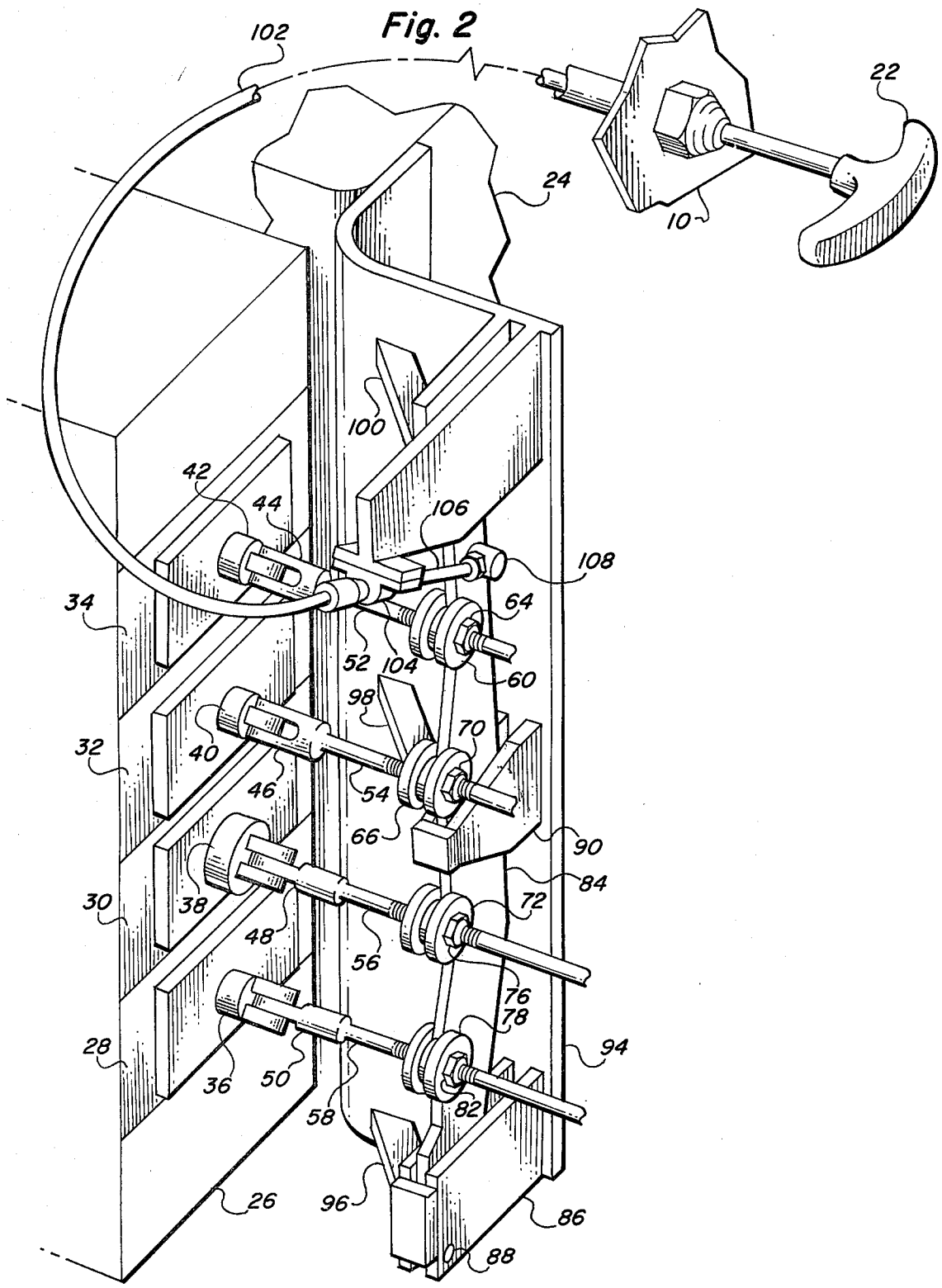
FIG. 2 is a perspective view of a plural hydraulic valve assembly with the locking mechanism of the invention showing the several hydraulic valve control shafts in a locked position.

It is a feature of the invention that a simple lock operated from the control console by "T" handle 22 will effect such locking. In the preferred embodiment, raising "T" handle 22 effects plural control locking. FIG. 2 is a perspective view illustrating the lock mechanism as applied to a plural hydraulic control valve assembly.

Figure 4:
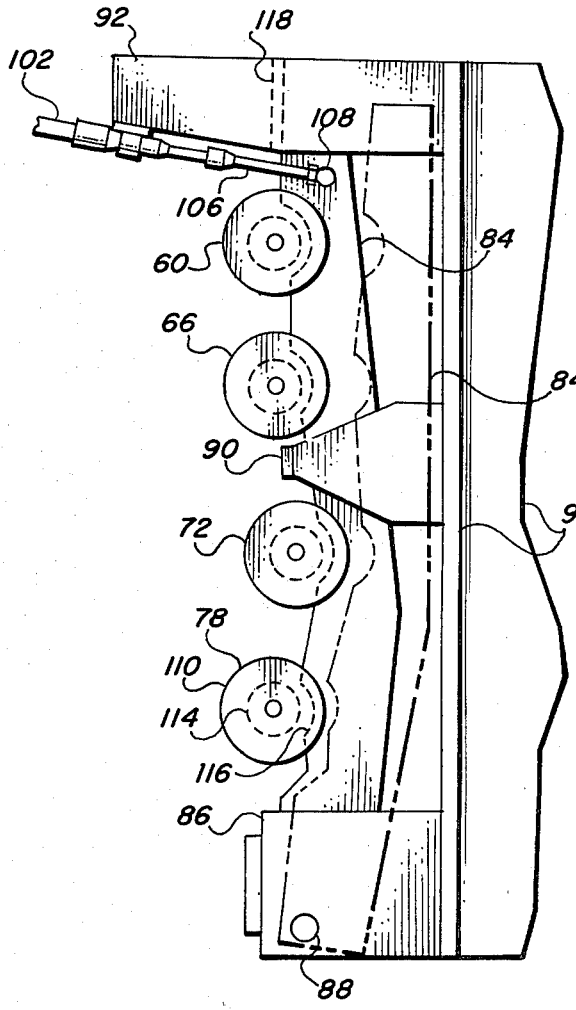
FIG. 4 is a side elevation view of a portion of the mechanism illustrated in FIGS. 2 and 3.
Figure 3:
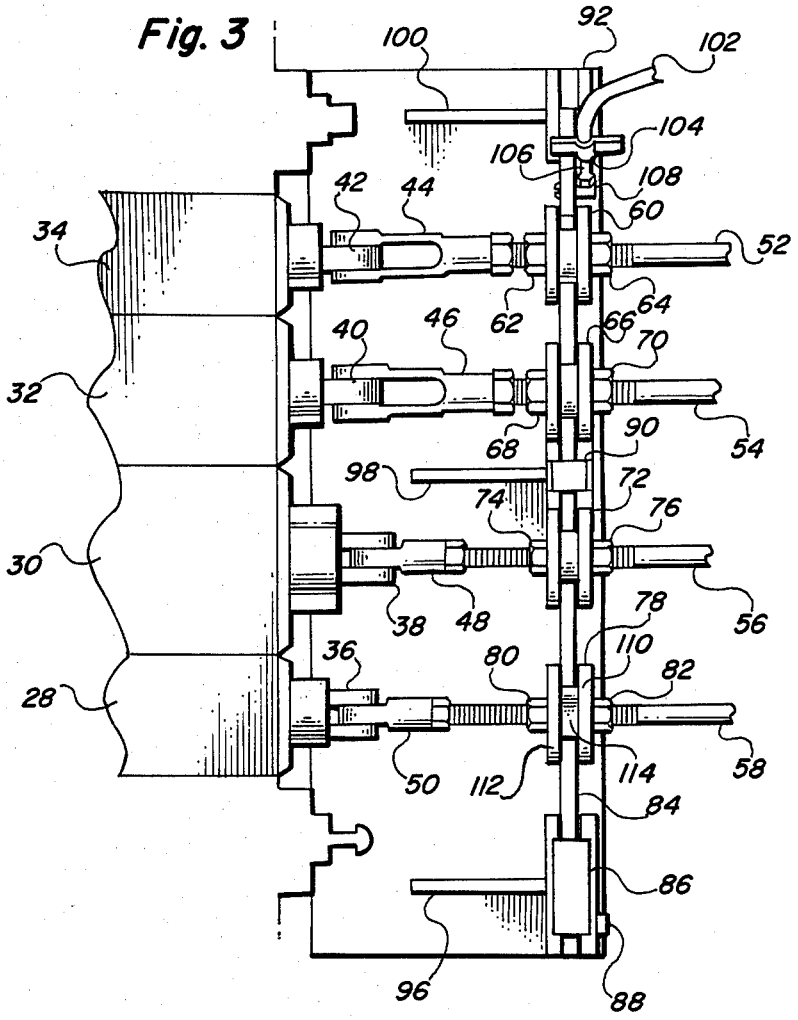
FIG. 3 is a front elevation view of the mechanism illustrated in FIGS. 2 and 4.

In FIG. 2, plural control stations are shown at 26. For a crawler tractor the control stations would ordinarily be hydraulic and are so illustrated. Thus, the control stations are shown as preferably comprising four hydraulic control valves separately shown at 28, 30, 32 and 34. In many applications, the valve assembly 26 is mounted on a hydraulic tank 24 which also provides the mounting for lock bracket 94 which supports the valve locking mechanism as hereafter described. For clarity in viewing the structure illustrated in FIG. 2, FIG. 3 and FIG. 4 are shown as front and side elevation views thereof. Control valve 28 has an actuator control comprising a control shaft 36 as does each of the valves, control shafts 38, 40 and 42 being associated with valves 30, 32 and 34 respectively and each functioning as an actuator control. Movement of each of the control shafts inward or outward with respect to its associated control valve body effects the control function of the valve; e.g., movement of control shaft 36 inward from a neutral position toward the valve body might control the raising of a crawler tractors moldboard (dozer blade) while movement outward from the neutral position would control lowering. Each of the control shafts is shown in its centered or neutral position in FIG. 2 (and FIGS. 3 and 4). In the neutral position, no hydraulic action takes place.

Affixed to each valves control shaft is a rod end and a control rod, rod end 44 and control rod 52 being associated with control shaft 42, rod end 46 and control rod 54 with control shaft 40, rod end 48 and control rod 56 with control shaft 38 and rod end 50 and control rod 58 with control shaft 36. To effect a locking action, it is a feature of the invention that a locking spool is secured to each control rod by a pair of nuts although other fastening means could be employed. However, the use of nuts permits easy adjustment of locking spool location which is advantageous as described hereafter. Locking spools 60 is secured to control rod 52 by nuts 62 and 64. Similarly, locking spools 66, 72, and 78 are secured to control rods 54, 56 and 58, respectively by nuts 68 and 70, 74 and 76 and 80 and 82 respectively.

As perhaps best seen in FIG. 3, each of the locking spools 60, 66, 72 and 78 has two equal diameter flanges and a hub portion of smaller diameter positioned there between. Spool 78, which is typical of the four spools, has flanges 110 and 112 disposed on either side of hub 114. It is an invention feature that use of locking spools as shown and described, permits a stronger construction than would a circumferential groove in the control rod on which the spool is positioned. Additionally, such a construction permits easy adjustment of the locking spools longitudinally along the axis of its associated control rod. Thus, it is possible to easily align the four spools in a straight line so that a single straight locking gate 84 can simultaneously be disposed between the locking spool flanges of all of the spools.

Locking of the control rods for the four hydraulic control valves is effected by engaging locking gate 84 between the spool flanges of spools 60, 66, 72 and 78. Locking gate 84 is supported by lock bracket 94 and locking gate pivot support 86 in alignment with the spools when the spools are in their neutral position. Bracket 94 is in turn secured to and is supported by hydraulic tank 24. As described above, when a hydraulic control valve is in its neutral position, no hydraulic action is taking place. Pivot 88, which may be secured in lock bracket 94 by any suitable fastener, passes through locking gate 84 to permit pivotal movement thereabout. A center guide 90 and end guide 92, constrains the alignment of locking gate 84 to the neutral alignment line of the locking spools. A stop 118, secured to end guide 92 limits movement of locking gate 84 in the direction toward the locking spools to avoid placing any strain on the control rods as might occur if gate 84 contacted the spool hubs. Locking gate pivot support 86 is braced against lock bracket 94 by gusset 96. Similarly, center guide 90 and end guide 92 are braced by gussets 98 and 100, respectively.

As described above, movement of "T" handle 22 effects locking and unlocking of the control valves. As shown in FIGS. 1 and 2, "T" handle is in its locked position. When the "T" handle is moved inward toward the control panel it moves a conventional control cable 102, with it. Control cable 102 is, in turn, connected to locking gate 84 by means of rod end 106 and pivot pin 108. Control cable 102 is secured to end guide 92 by clamp 104 in conventional fashion. Pivot pin 108 is rotatably positioned in a hole through locking gate 84 and secured in this position by conventional means such as a cotter key or "E" ring. Thus, movement of "T" handle inward and outward effects movement of locking gate 84 to its unlocked and locking positions, respectively. These positions are best seen in FIG. 4 where gate 84 is shown in solid outline in its locking position and in phantom outline at 84' in its unlocked position.

As can be seen in FIG. 4, when locking gate 84 is in its leftward or locking position, recesses in its edge surface are aligned with the hubs of each of the control rod locking spools and it is positioned between both flanges of each spool. Thus, with respect to spool 78, recess 116 is aligned with hub 114, and the gate lies between flanges 110 and 112 and similarly for each of the locking spools. With the gate thus positioned in its locking position, movement of the control rods and hence the hydraulic control shafts is inhibited and the valves are maintained in their neutral positions. Then, when "T" handle 22 is moved inwardly, locking gate 84 moves to its unlocked position 84' where it does not interfere with any of the locking spools and each hydraulic control valve can then be displaced from its neutral position as the machinery operator desires.

In the foregoing description of the inventive valve locking system, and its manner of operation, no mention was made of a detent friction retainer means or the like for the system to maintain the lock in either locked or unlocked positions. Such a detent or other retainer means is desirable but, since the type of retainer means employed is dependent on the application of the locking system and since the retainer means may form a small part of the invention, it is not particularly described herein.

The above described embodiments list the various components of the invention elements in an environment such as might be encountered in a bulldozer type crawler tractor. Further, while the use of invention was described in connection with a four control valve hydraulic system, it can be appreciated that the valve locking mechanism of the invention could be used with any number of such control valves, including one or more.

From the foregoing description, it can be seen that the invention is well adapted to attain all of the ends and objects set forth together with other advantages which are obvious and inherent to the apparatus. Further, it should be understood that certain features and subcombinations are useful and may be employed without reference to other features and subcombinations.

The detailed descriptions of the invention herein has been with respect to preferred embodiments thereof. However, it will be understood that variations and modifications can be effected within the spirit and scope of the invention as described hereinabove and as defined in the appended claims.

What is claimed is:

1. In combination, one or more control actuators and an apparatus for locking said one or more control actuators, comprising control rod means associated with each of said one or more control actuators, said control rod means having circumferential groove means thereon, support frame means secured in alignment with said one or more control actuators and their associated control rod means, locking gate means pivotally secured to said support frame means to permit gate movement toward engagement with and away from engagement with said circumferential groove means of said control rod means, and means for selectively moving said locking gate into engagement with and for disengaging said locking gate from said circumferential groove means, whereby said control rods are selectively locked in position and said control actuators thereby inhibited from operation.

2. An apparatus for locking the control rod means of one or more control actuators in accord with claim 1 wherein said circumferential groove means of said control rod means is provided by a locking spool comprising two flanges and a hub of smaller diameter positioned therebetween.

3. An apparatus for locking the control rod means of one or more control actuators in accord with claim 2 further comprising fastening means for securing each of said locking spools on said control rod means while simultaneously permitting longitudinal adjustment of spool position along the axis of its associated control rod means.

4. In combination, control actuators and an apparatus for locking said control actuators, comprising control rod means associated with each of said control actuators, said control rod means having circumferential groove means thereon, support frame means secured in alignment with said control rod means, gate support means and guide means disposed on and secured to said support frame means and aligned with said circumferential grooves, locking gate means secured to said gate support means by pivot means and pivotable thereabout and maintained in alignment with said circumferential groove means by said guide means, said locking gate means being adapted for movement about said pivot to selectively permit engagement and disengagement of said gate means with said circumferential groove means, and means for selectively moving said locking gate means between a circumferential groove means engaging position and disengaged position whereby said control actuators are respectively selectively inhibited from operation or free to be operated.

5. Locking apparatus for plural control actuators in accord with claim 4 wherein said circumferential groove means of said control rod means are provided by axially adjustable locking spool means, said locking spool means comprising dual flange means and a hub of smaller diameter positioned therebetween.

6. In the method of locking one or more control stations in a neutral position by means of an apparatus of the type where each control station has an actuator control shaft movable about a neutral position to effect operation of the control station, each actuator control shaft further comprises a circumferential groove therein and the apparatus includes a pivotally supported locking gate means for selectively simultaneously engaging all said circumferential grooves to thereby lock all of said control shafts in neutral position, the improvement comprising the steps of disposing said actuator control shafts so that their respective circumferential grooves are arranged in a line with respect to each other and in alignment with said pivotally supported locking gate means, and simultaneously engaging said pivotally supported locking gate means with said circumferential grooves of each of said actuator control shafts to thereby effect said neutral position locking.

7. In the method of locking one or more control stations in a neutral position by means of an apparatus of the type where each control station has an actuator control shaft movable about a neutral position to effect operation of the control station, a locking spool on each actuator control shaft comprising a pair of flanges with a smaller diameter hub therebetween to thereby describe a circumferential groove about said actuator control shaft, and a pivotally support locking gate means for selectively simultaneously engaging said circumferential grooves of said locking spools, the improvement comprising the steps of disposing said locking spools on said actuator control shafts so that their respective circumferential grooves are arranged in a line with respect to each other and in alignment with said pivotally supported locking gate means, and selectively moving said pivotally connected locking gate means between circumferential groove engaged and disengaged positions whereby said control stations are locking in neutral position or free to operate, respectively.

* * * * *